US009377745B2

(12) United States Patent
Oba

(10) Patent No.: US 9,377,745 B2
(45) Date of Patent: Jun. 28, 2016

(54) IMAGE FORMING APPARATUS HAVING A CLEANING DEVICE FOR AN IMAGE CARRIER

(71) Applicant: KYOCERA Document Solutions Inc., Osaka (JP)

(72) Inventor: Keisuke Oba, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/858,655

(22) Filed: Sep. 18, 2015

(65) Prior Publication Data

US 2016/0085202 A1 Mar. 24, 2016

(30) Foreign Application Priority Data

Sep. 22, 2014 (JP) ..... 2014-192469

(51) Int. Cl.
*G03G 21/00* (2006.01)
*G03G 15/16* (2006.01)

(52) U.S. Cl.
CPC ..... *G03G 21/0011* (2013.01); *G03G 15/161* (2013.01); *G03G 2215/1661* (2013.01)

(58) Field of Classification Search
CPC ..... G03G 15/0896; G03G 2215/0877; G03G 2221/1648; G03G 2221/0047; G03G 2221/0052; G03G 2215/1647; G03G 2215/1661; G03G 21/0011; G03G 15/161
See application file for complete search history.

(56) References Cited

U.S. PATENT DOCUMENTS 4,819,026 A * 4/1989 Lange ..... G03G 21/0035 15/256.51
5,455,665 A * 10/1995 Baba ..... G03G 21/0011 15/256.5
2002/0001489 A1* 1/2002 Ozaki ..... G03G 15/167 399/298
2008/0075500 A1* 3/2008 Kawata ..... G03G 21/0011 399/102
2014/0153956 A1 6/2014 Yonemoto
2014/0241751 A1* 8/2014 Morishita ..... G03G 15/161 399/101

FOREIGN PATENT DOCUMENTS

JP 2010-085984 A 4/2010
JP 2014-109592 A 6/2014

OTHER PUBLICATIONS

The extended European search report issued by the European Patent Office on Feb. 18, 2016, which corresponds to European Patent Application No. 13183271.4-1568 and is related to U.S. Appl. No. 14/858,655.

* cited by examiner

*Primary Examiner* — David Gray
*Assistant Examiner* — Laura Roth
(74) *Attorney, Agent, or Firm* — Studebaker & Brackett PC

(57) ABSTRACT

An image forming apparatus includes an image carrier, a rotating brush, a collecting roller, a cleaning blade, a sealing member and a side sealing member. The sealing member has an extension part extending outside from each end of the collecting roller in an axial direction. The sealing member comes into contact with the collecting roller between a contact area between the rotating brush and the collecting roller and the cleaning blade and then prevents backflow of the residue. The side sealing member lifts the extension part toward the collecting roller on an outside at a predetermined interval from a position corresponding to each side edge of a maximum-width sheet passing region on the image carrier.

9 Claims, 5 Drawing Sheets

IMAGE FORMING APPARATUS HAVING A CLEANING DEVICE FOR AN IMAGE CARRIER

INCORPORATION BY REFERENCE

This application is based on and claims the benefit of priority from Japanese Patent application No. 2014-192469 filed on Sep. 22, 2014, the entire contents of which are incorporated herein by reference.

BACKGROUND

The present disclosure relates to an image forming apparatus provided with a cleaning device which removes a toner from an image carrier.

In an electrographic image forming apparatus, such as a printer, a facsimile machine or a multifunction peripheral, a toner remained on an image carrier is removed by a cleaning device after a toner image has been transferred to a transfer sheet. Also, in a full color image forming apparatus, an intermediate transferring belt made of resin or an intermediate transferring belt having an elastic layer is used as an image carrier.

In the case of the intermediate transferring belt made of resin, a cleaning device in which an edge of a blade made of a urethane rubber or the like presses against a surface of the intermediate transferring belt to scrape the toner is generally used because of its simple construction and inexpensiveness. On the other hand, in the case of the intermediate transferring belt having an elastic layer, there is mainly used a cleaning device in which the toner is mechanically and electrically swept from a surface of the intermediate transferring belt by a rotating brush, the swept toner is moved from the rotating brush to a collecting roller by an electrostatic force, the toner adhering to the collecting roller is scraped by a cleaning blade, and the scraped tonner is delivered to a collecting tank by a collecting screw.

In the cleaning device having the rotating brush, the collecting roller and the cleaning blade, on an upstream side from the cleaning blade in a rotating direction of the collecting roller, a sealing member is provided so as to abut against the collecting roller, preventing backflow of the scraped toner. Further, in order to prevent a leakage of the toner from both side edges of the sealing member, there may be a case in which side ends of the sealing member are supported so as to come closer to the collecting roller by side sealing members.

However, in a case where the sealing member and the side sealing members are provided, the toner or sheet powder collected on the collecting roller is dammed and accumulated by the sealing member and the side sealing members, and there may occur a failure that the accumulated tonner or the like drops. In particular, a large amount of sheet powder generated from cut faces of both side edges of the transfer sheet exists on each side end of the collecting roller. In addition, the side ends of the collecting roller are applied with a pressure from the sealing member by the side sealing members. Thus, the accumulation of the sheet powder or toner becomes remarkable at the side ends of the collecting roller.

Also, it is considered that the surface of the collecting roller is subjected to an alumite processing to form a high resistance layer on the surface and then an electrical adhesion force between the collecting roller and the toner or sheet powder is set to be higher than an abutment force between the collecting roller and the sealing member to prevent damming of the toner or the like by the sealing member and the side sealing members. However, if the adhesion force between the collecting roller and the toner is increased, it becomes difficult to scrape the toner from the collecting roller by the cleaning blade. Also, if a pressure applied from the cleaning blade to the collecting roller is increased in order to increase a toner scraping force, the cleaning blade may be shaved or a torque applied to the collecting roller or the like may be increased.

SUMMARY

In accordance with an embodiment of the present disclosure, an image forming apparatus includes an image carrier, a rotating brush, a collecting roller, a cleaning blade, a sealing member and a side sealing member. The image carrier has a surface on which a toner image is formed. The rotating brush comes into contact with the surface of the image carrier and then collects a residue adhering to the surface after transferring the toner image to a transfer sheet. The collecting roller comes into contact with the rotating brush on a downstream side in a rotating direction of the rotating brush from a contact area between the image carrier and the rotating brush and then removes the residue collected by the rotating brush. The cleaning blade abuts against the collecting roller on a downstream side in the rotating direction of the collecting roller from a contact area between the rotating brush and the collecting roller and then scrapes the residue collected by the collecting roller. The sealing member has an extension part extending outside from each end of the collecting roller in an axial direction, and comes into contact with the collecting roller between the contact area between the rotating brush and the collecting roller and the cleaning blade and then prevents backflow of the residue. The side sealing member lifts the extension part toward the collecting roller on an outside at a predetermined interval from a position corresponding to each side edge of a maximum-width sheet passing region on the image carrier.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to an embodiment of the present disclosure will be described.

Figure 1:
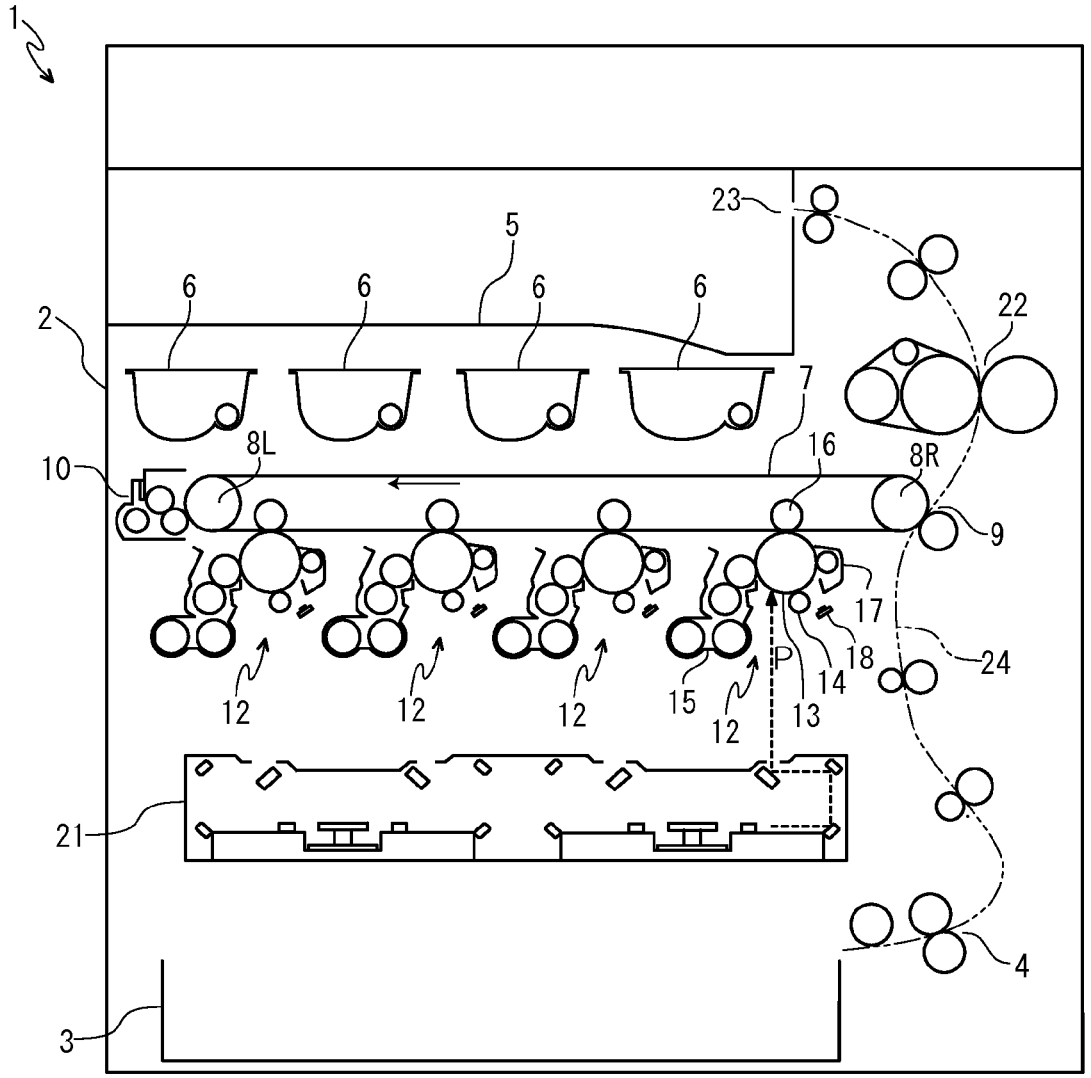
FIG. 1 is a schematic view showing an outline of a color printer according to an embodiment of the present disclosure.

First, with reference to FIG. 1, the entire structure of a color printer 1 (image forming apparatus) will be described. FIG. 1 is a schematic diagram schematically showing a color printer according to an embodiment of the present disclosure. In the following description, a front side of the sheet plane of FIG. 1 shows a front side of the color printer 1 and left and right directions are based on a direction viewed from the front side of the color printer 1.

The color printer 1 is provided with a box-like shaped printer main body 2. In a lower part of the printer main body 2, a sheet feeding part 4 configured to feed a transfer sheet from a sheet feeding cassette 3 is provided, and on an upper face of the printer main body 2, an ejected sheet tray 5 is provided. Inside the printer main body 2, toner containers 6 respectively storing different color (magenta, cyan, yellow and black) toner (developer) are arranged in an upper space. Under the toner containers 6, an intermediate transferring belt 7 (image carrier) is bridged around left and right rollers 8L, 8R. On one end (right end in FIG. 1) of the intermediate transferring belt 7, a second transferring part 9 is formed. On the other end of the intermediate transferring belt 7, a cleaning device 10 is provided. The intermediate transferring belt 7, the left and right rollers 8L, 8R and the cleaning device 10 are integrated into an intermediate transferring unit. Under the intermediate transferring belt 7, four image forming parts 12 is provided for respective toner colors.

In the image forming part 12, a photosensitive drum 13 is rotatably provided. Around the photosensitive drum 13, a charger 14, a development unit 15, a transfer roller 16, a photosensitive drum cleaning device 17 and a static eliminator 18 are arranged along a rotating direction of the photosensitive drum 13. Under the image forming parts 12, an exposure device 12 containing a laser scanning unit (LSU) is arranged. Above the second transferring part 9, a fixing device 22 is provided. Above the fixing device 22, a sheet ejecting unit 23 facing the ejected sheet tray 5 is provided.

In the printer main body 2, a transfer sheet conveying path 24 is formed extending vertically from the sheet feeding part 4 to the sheet ejecting unit 23 through the second transferring part 9 and the fixing device 22.

Next, the operation of forming an image by the color printer 1 having such a configuration will be described. When image data is inputted from a computer or the like connected to the color printer 1, the image forming operation is carried out as follows.

After the surface of the photosensitive drum 13 is charged by the charger 14, the exposure device 21 exposes the surface of the photosensitive drum 13 with a laser light (refer to the dotted line p in FIG. 1) in accordance to the image data to form an electrostatic latent image on the surface of the photosensitive drum 13. The electrostatic latent image is then developed into a toner image of respective color by the developing unit 15. The toner images are first-transferred on the intermediate transferring belt 7 by the transferring roller 16. The above-mentioned operation is repeated in order by the respective image forming parts 12, thereby forming a full color toner image onto the intermediate transferring belt 7. Incidentally, toner and residual electric charge remained on the photosensitive drum 13 is removed by the cleaning device 17 and the static eliminator 18, respectively.

On the other hand, the transfer sheet fed from the sheet feeding cassette 3 by the sheet feeding part 4 or a bypass tray (not shown) is conveyed to the second transferring part 9 in a suitable timing for the above-mentioned image forming operation. Then, in the second transferring part 9, the full color toner image on the intermediate transferring belt 7 is second-transferred onto the transfer sheet. The transfer sheet with the second-transferred toner image is conveyed to a downstream side along the transfer sheet conveying path 24 to enter the fixing part 22, and then, the toner image is fixed on the transfer sheet in the fixing part 22. The transfer sheet with the fixed toner image is ejected from the sheet ejecting unit 23 onto the ejected sheet tray 5.

Figure 2:
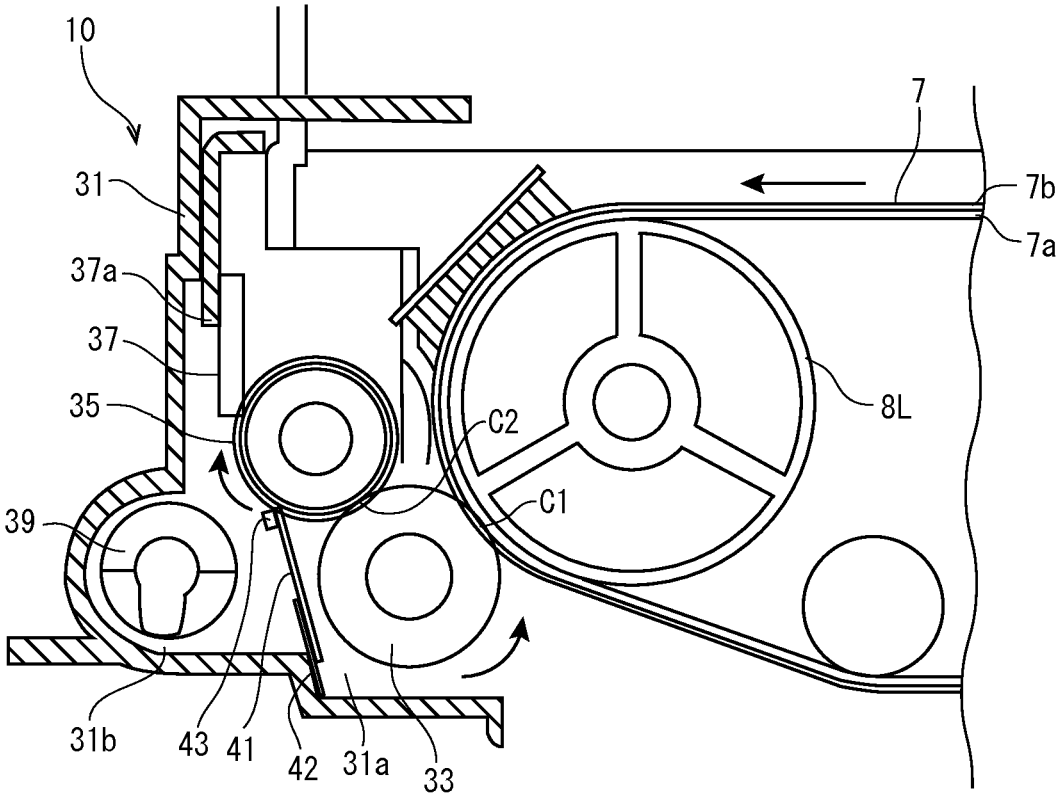
FIG. 2 is a front view showing a cleaning device for intermediate belt in the color printer according to the embodiment of the present disclosure.
Figure 3:
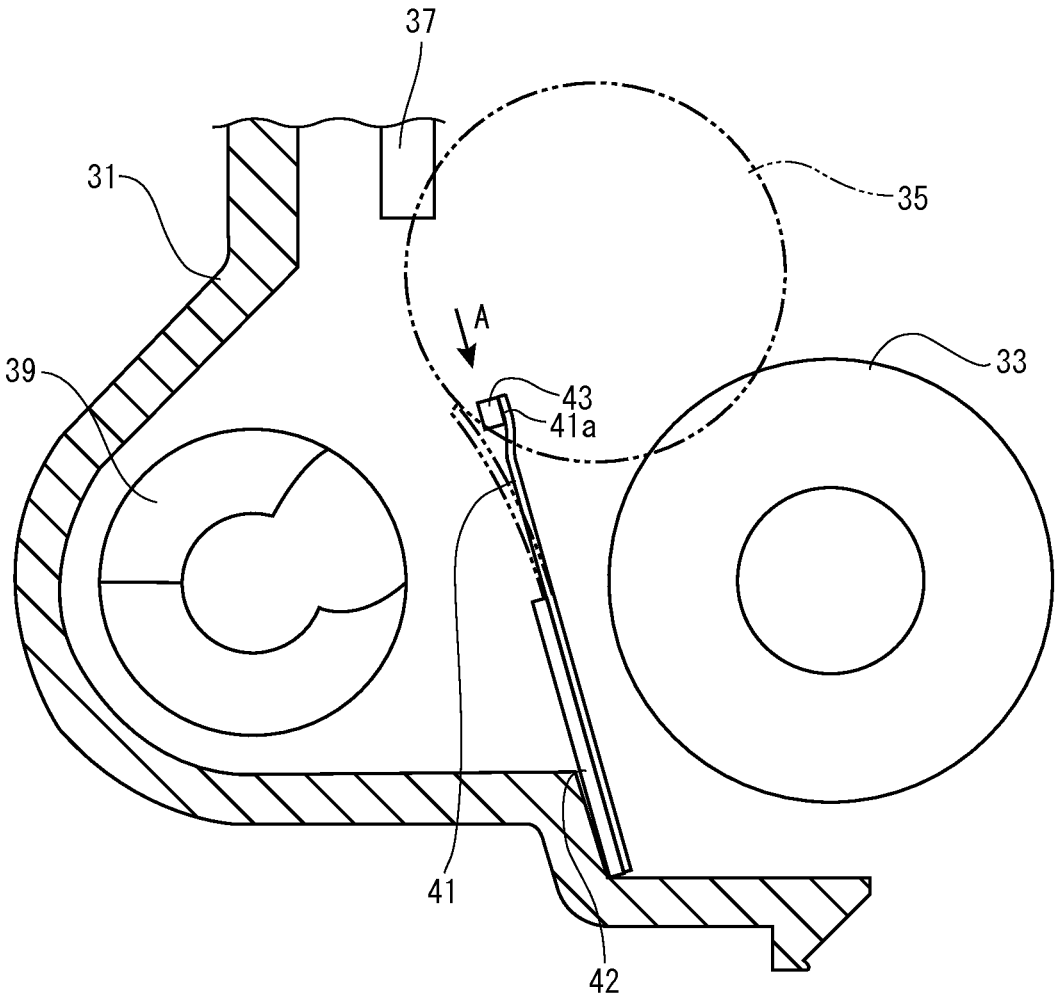
FIG. 3 is a front view showing a sealing member in a cleaning device of the color printer according to the embodiment of the present disclosure.

Next, with reference to FIGS. 2 to 4B, the cleaning device 10 will be described. FIG. 2 is a front view of the cleaning device; FIG. 3 is a front view mainly showing a sealing member; FIG. 4 is a view showing the sealing member and a side sealing member viewed from a direction indicated by an arrow A of FIG. 3; and FIG. 4B is a view showing the sealing member and the side sealing member viewed from the front side.

As shown in FIG. 2, the cleaning device 10 is disposed to oppose to the left roller 8L around which the intermediate transferring belt 7 is bridged. The intermediate transferring belt 7 has a substrate layer 7*a* made of resin, an elastic layer 7*b* and a coating layer (not shown) which are laminated on an outer layer side of the substrate layer 7*a* in the order. The elastic layer 7*b* is made of a urethane rubber, for example. The outer layer is made of PTFE (polytetrafluoroethylene).

The cleaning device 10 has a supporting member 31, a rotating brush 33, a collecting roller 35, a cleaning blade 37, a screwing member 39, a sealing member 41 and side sealing members 43. The supporting member 31 supports the rotating brush 33, the collecting roller 35, the cleaning blade 37, the screwing member 39, the sealing member 41 and the side sealing members 43. The rotating brush 33 is configured to come into contact with a surface of the intermediate transferring belt 7 and then collect the toner from the surface of the intermediate transferring belt 7. The collecting roller 35 is configured to come into contact with the rotating brush 33 and then collect the toner from the rotating brush 33. The cleaning blade 37 is configured to abut against the collecting roller 35 and then scrape the toner. The screwing member 39 is configured to collect the scraped toner. The sealing member 41 is configured to abut against the collecting roller 35 and then prevent backflow of the toner. The side sealing members 43 are provided on each side end of the sealing member 41 in a width direction of the transfer sheet.

The supporting member 31 is a box-shaped member of which one face opens, and is provided on the intermediate transferring unit so that the opening faces the left roller 8L.

The rotating brush 33 is supported rotatably in the counterclockwise direction of FIG. 2 so as to come into contact with the surface of the intermediate transferring belt 7 through the opening of the supporting member 31 in a counter direction relative to the traveling direction of the intermediate transferring belt 7. The rotating brush 33 is formed by a fur brush using a brush fiber made of electrically conductive resin, such as electrically conductive polyester or electrically conductive nylon, for example.

The collecting roller 35 is supported rotatably in the clockwise direction of FIG. 2 so as to come into contact with the rotating brush 33 on a downstream side in the rotating direction of the rotating brush 33 from a contact area C1 between the rotating brush 33 and the intermediate transferring belt 7.

The collecting roller 35 is formed by subjecting a surface of a substrate made of SUM (sulfur-composite free cutting steel) to a nickel plating processing. The surface of the collecting roller 35 has a surface ten-point average roughness Rz (JIS94 Standard) of 2 μm or less and a maximum height Ry (JIS94 Standard) of 6.3 μm or less.

A bias current of a reverse polarity to that of the toner is applied to the collecting roller 35. The applied current can be varied, and in a case where a large amount of toner is removed, for example, in a case where it is necessary to clean the toner image formed on the intermediate transferring belt 7 in the event of sheet jamming or the like, a high current is applied.

A substantially upper half of the cleaning blade 37 is fixedly attached to a supporting plate 37*a*. The supporting plate 37*a* is supported by the supporting member 31 so that the cleaning blade 37 abuts against the collecting roller 35 in the counter direction relative to the rotating direction of the collecting roller 35 on a downstream side in the rotating direction of the collecting roller 35 from a contact area C2 between the rotating brush 33 and the collecting roller 35. The cleaning blade 37 is made of resin, such as polyurethane or PET, for example.

The screwing member 39 is rotatably supported under the cleaning blade 37.

The sealing member 41 is a sheet-shaped member having a width larger than a length of the collecting roller 35 in an axial direction. A substantially lower half of the sealing member 41 is fixedly attached to an attachment plate 42. The attachment plate 42 is positioned in the axial direction of the collecting roller 35 so that each side end of the sealing member 41 extends outside from each side end of the collecting roller 35. In the following description, a portion extending outside from each side end of the collecting roller 35 is defined as an extension part 41*a*. Also, the attachment plate 42 is supported by the supporting member 31 so that the sealing member 41 comes into contact with the collecting roller 35 from the upstream side in the rotating direction of the collecting roller 35 between the contact area C2 of the rotating brush 33 with the collecting roller 35 and the cleaning blade 37.

As shown in FIG. 3, in a state in which the collecting roller 35 is not supported by the supporting member 31, the sealing member 41 is supported to be straightly inclined in an oblique left upward direction (refer to the solid line of FIG. 3). If the collecting roller 35 is supported by the supporting member 31, the sealing member 41 is pressed by the surface of the collecting roller 35, is elastically deformed so as to warp in a leftward direction of FIG. 3, and is pressed against the collecting roller 35 with a predetermined pressure (refer to the double-dotted chain line of FIG. 3). The sealing member 41 is made of a urethane sheet, for example.

Figure 4A:
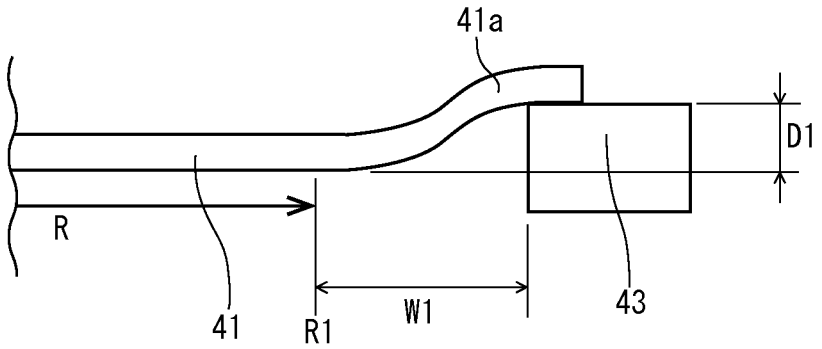
FIG. 4A is a view showing the sealing member and a side sealing member viewed from a direction indicated by an arrow A of FIG. 3 in the cleaning device of the color printer according to the embodiment of the present disclosure.
Figure 4B:
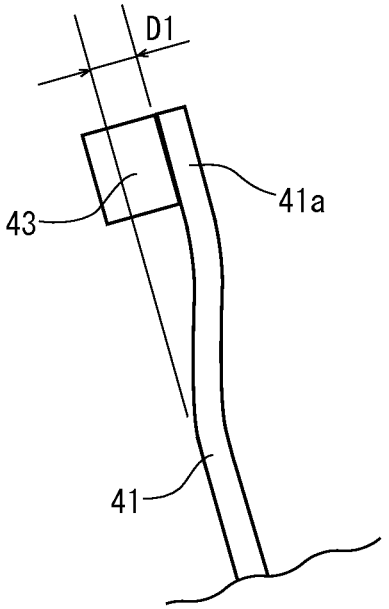
FIG. 4B is a view showing the sealing member and the side sealing member viewed from a front side in cleaning device of the color printer according to the embodiment of the present disclosure.

The side sealing member 43 according to the first embodiment, as shown in FIG. 3, FIG. 4A and FIG. 4B, is supported by the supporting member 31 so as to oppose to each extension part 41*a* of the sealing member 41 from an opposite side of the collecting roller 35. The side sealing member 43 is made of foamed urethane, for example.

As shown in FIGS. 4A and 4B, in the state in which the collecting roller 35 is not supported by the supporting member 31, each extension part 41*a* of the sealing member 41 is lifted so as to come closer to the collecting roller 35 by a predetermined distance D1 with the side sealing member 43. Also, as shown in FIG. 4A, the side sealing members 43 are disposed outside by a predetermined distance W1 from positions R1 corresponding to side edges of a maximum width-size transfer sheet passing region R on the intermediate transferring belt 7.

In a state in which each extension part 41*a* of the sealing member 41 is lifted by the side sealing member 43, if the collecting roller 35 is supported by the supporting member 31, a portion of the sealing member 41 between both extension parts 41*a* comes into contact with an entire region in the axial direction of the collecting roller 35 at a substantially constant pressure of such strength that no gap is formed between the portion between the extension parts 41*a* and the collecting roller 35. However, since the extension parts 41*a* are lifted to come closer to the collecting roller 35, a pressure applied from the sealing member 41 to the collecting roller 35 becomes comparatively high at a vicinity of each side end of the collecting roller 35. Also, since the vicinity of each side end of the collecting roller 35 is close to the position R1 corresponding to each side edge of the maximum width-size transfer sheet passing region R on the intermediate transferring belt 7, a large amount of sheet powder is generated from each side edge face of the transfer sheet. Due to these facts, at each side end of the collecting roller 35, the sheet powder or the like is easily accumulated, in particular.

Therefore, if the position R1 corresponding to each side edge of the maximum width-size transfer sheet passing region R on the intermediate transferring belt 7 and a position at which the pressure applied to the collecting roller 35 from the sealing member 41 becomes high are spaced from each other as far as possible, it is predicted that the accumulation of sheet powder or the like can be prevented. Hence, a relationship between the position of the side sealing member 43 and an accumulation state of sheet powder or the like was obtained by way of a following experiment.

An experimental conditions are shown below.

Machine targeted to be tested: Color printer (remodeled machine of EcosysP6035 available from Kyocera Document Solution Co., Ltd.).

Intermediate transferring belt 7: one obtained by laminating the substrate layer 7*a* made of PVDF (vinylidene polyfluoride), the elastic layer 7*b* made of urethane and the outer layer made of PTFE (polytetrafluoroethylene) in the order (available from Okura Industrial Co., Ltd.).

Rotating brush 33: Fur brush made of electrically conductive acrylic fiber (available from Toei Sangyo Co., Ltd.).

Collecting roller 35: one obtained by subjecting a surface of SUM-based substrate to a nickel plating processing. The surface ten-point average roughness is 1.5 μm and the maximum height Ry is 6.3 μm.

Cleaning blade 37: Polyurethane rubber-based blade (available from NOK Corporation).

Blade weighting manner: Constant displacement manner.

Sealing member 41: Urethane sheet with a thickness of 0.1 mm (available from Nihon Matai Co., Ltd.).

Side sealing member 43: Soft urethane foam (available from INOAC Corporation).

Bias applied to collecting roller 35: −3 μA.

Amount of biting of the rotating brush 33 into the intermediate transferring belt 7 at the contact area C1: 1.0 mm.

Amount of biting of the rotating brush 33 into the collecting roller 35 at the contact area C2: 1.5 mm.

In the experimental condition described above, a lifting height D1 (hereinafter, referred to as a height difference D1) of the extension part 41*a* of the sealing member 41 toward the collecting roller 35 by the side sealing members 43 was set to 0.5 mm, 1 mm and 1.5 mm and a distance W1 (hereinafter, referred to as a spacing distance W1) between the position R1 corresponding to each side edge of the maximum width-size transfer sheet passing region R and the side sealing member 43 was varied to 3 mm, 5 mm, 8 mm and 10 mm. Then, an image of a test document with a predetermined printing rate was formed on 1,000 sheets of plain sheet (available from JKSHEET Co., Ltd.), and subsequently, an accumulation state of sheet powder or the like was determined by visually observing the collecting roller 35. As to the accumulation state of sheet powder, a case in which almost no accumulation was observed was defined as O; a case in which accumulation to an extent such that a problem occurs was observed was defined as X; and an intermediate state thereof was defined as Δ. The results of the determination are shown in Table 1.

TABLE 1

| | | a spacing distance W1 (mm) between side edge of sheet and side sealing member | | | |
|---|---|---|---|---|---|
| | | 3 | 5 | 8 | 10 |
| a height difference D1 (mm) between sealing member and side sealing member | 0.5 | X | Δ | ○ | ○ |
| | 1.0 | X | X | ○ | ○ |
| | 1.5 | X | X | ○ | ○ |

From Table 1, it is found that the smaller the height difference D1 is and the longer the spacing distance W1 is, the less the accumulation of sheet powder is. Namely, if the height difference D1 is small, since an abutment pressure applied to the collecting roller 35 from the sealing member 41 becomes low, even in a case where the spacing distance W1 is short, the accumulation of sheet powder hardly occurs. On the other hand, if the height difference D1 is large, since the abutment pressure applied to the collecting roller 35 from the sealing member 41 becomes high, it is necessary to increase the spacing distance W1. From Table 1, in order to prevent the accumulation of sheet powder, in the experimental conditions described previously, it is found that the height difference D1 is required to be within a range of 0.5 mm to 1.5 mm and the spacing distance W1 is required to be 8 mm or more.

In the cleaning device 10 having the construction mentioned above, the residue, such as the residual toner or sheet powder, that remains on the surface of the intermediate transferring belt 7 is collected by the brush fibers at the contact area C1 between the intermediate transferring belt 7 and the rotating brush 33. The collected residue is transferred from the brush fibers to the collecting roller 35 at the contact area C2 between the rotating brush 33 and the collecting roller 35 due to a potential difference between the rotating brush 33 and the collecting roller 35. The thus transferred residue to the collecting roller 35 is mechanically scraped by the cleaning blade 37 and then dropped. The thus scraped residue is discharged to the outside of the apparatus by the screwing member 39.

In addition, the sealing member 41 abuts against the collecting roller 35 at a pressure of such strength that the toner or sheet powder collected by the collecting roller 35 is not dammed. This prevents backflow of the toner from a space 31*b* on a side of the cleaning blade 37 into a space 31*a* on a side of the rotating brush 33. Further, the side sealing members 43 prevents a leakage of the toner or sheet powder from each side edge of the sealing member 41.

As has been described above, in the cleaning device 10 of the color printer 1 according to the embodiment, since a portion at which the extension part 41*a* of the sealing member 41 is lifted by the side sealing members 43 and a portion at which the accumulation of sheet powder easily occurs (the position R1 corresponding to each side edge of the maximum width-size transfer sheet passing region R) are spaced from each other, the sealing member 41 comes into contact with the collecting roller 35 in a substantially straight posture along the collecting roller 35 as well as the portion at which the accumulation of sheet powder easily occurs. Therefore, the sheet powder or toner adhering to the collecting roller 35 is scraped and collected by the cleaning blade 37 without being dammed by the sealing member 41 all over the axial direction of the collecting roller 35. Further, the sealing member 41 can surely prevent the backflow of the collected sheet powder or the like.

Also, even if a pressure is applied to the collecting roller 35 from the sealing member 41, since the surface of the collecting roller 35 has a surface ten-point average roughness of 2 μm or less and a maximum surface height Ry of 6.3 μm or less, the toner or sheet powder collected from the rotating brush 33 can be kept on the collecting roller 35 without being scraped by the sealing member 41. Therefore, the toner or sheet powder collected on the collecting roller 35 can be reliably scraped by the cleaning blade 37. Accordingly, since it is not necessary to increase the abutment pressure of the cleaning blade 37, shaving of the cleaning blade 37 or the increase of the torque applied to the collecting roller 35 or the like can be prevented.

In addition, since the collecting roller 35 is formed by subjecting a surface of a substrate made of SUM (sulfur-composite free cutting steel) to a nickel plating processing, it is not necessary to apply an alumite processing in order to increase a resistance of the surface of the collecting roller 35. Therefore, the collecting roller 35 can be formed inexpensively.

Further, since a bias with an opposite polarity to the charging polarity of the toner is applied to the collecting roller 35 and the toner is electrically moved from the rotating brush 33 to the collecting roller 35, a removal efficiency of the tonner from the rotating brush 33 can be increased. Therefore, a cleaning performance for the intermediate transferring belt 7 by the rotating brush 33 can be increased.

Figure 5A:
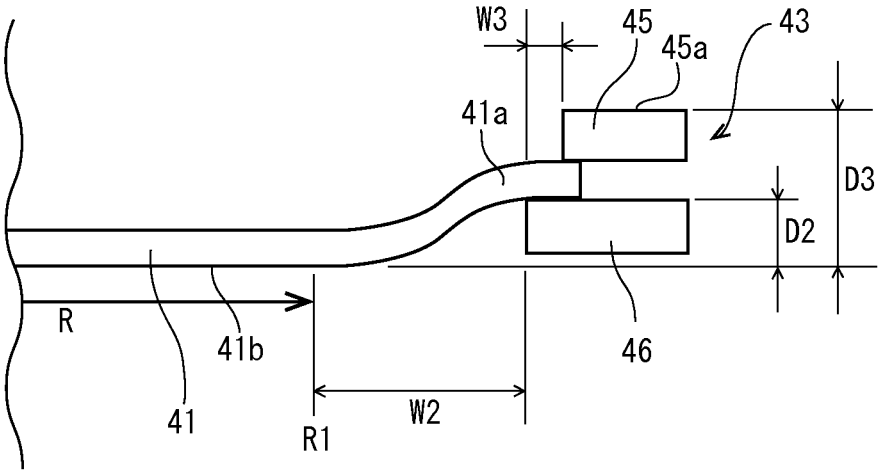
FIG. 5A is a view showing the sealing member and a side sealing member according to a second embodiment viewed in the same direction as that indicated by the arrow A of FIG. 3 in the cleaning device of the color printer according to the embodiment of the present disclosure.

Next, with reference to FIGS. 5A and 5B, a side sealing member 43 according to a second embodiment will be described. FIG. 5A is a view showing the sealing member and the side sealing member viewed in the same direction as that indicated by the arrow A of FIG. 3, and FIG. 5B is a view showing the sealing member and the side sealing member viewed from the front side.

The side scaling member 43 has a first sealing member 45 and a second sealing member 46 which sandwich each extension part 41*a* of the sealing member 41 between a face on a collecting roller side and an opposite face to the collecting roller side. The first sealing member 45 and the second sealing member 46 are made of foamed urethane, for example.

Figure 5B:
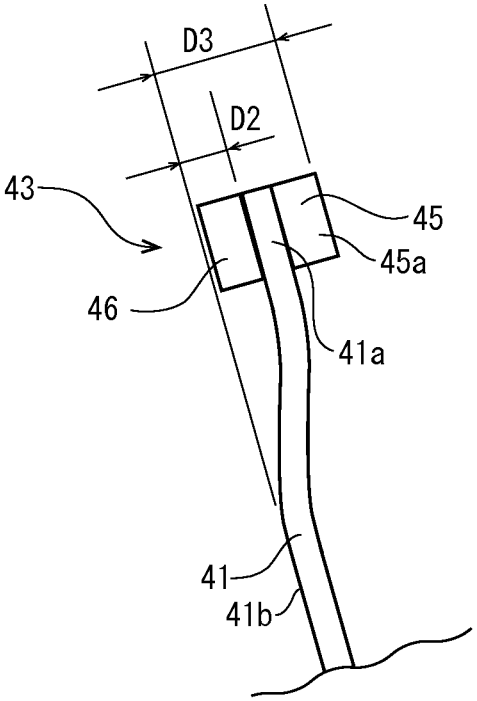
FIG. 5B is a view showing the sealing member and the side sealing member according to the second embodiment viewed from the front side in the cleaning device of the color printer according to the embodiment of the present disclosure.

As shown in FIGS. 5A and 5B, in the state in which the collecting roller 35 is not supported by the supporting member 31, each extension part 41*a* of the sealing member 41 is sandwiched between the upper and lower sealing members 45, 46 and is lifted so as to come closer to the collecting roller 35 by a predetermined distance D2. Also, the lower sealing member 46 is disposed outside by a predetermined distance W2 from the position R1 corresponding to each side edge of the maximum width-size transfer sheet passing region R.

Incidentally, a gap D3 between a face 45*a* on a side of collecting roller 35 of the first sealing member 45 and a face 41*b* opposite to the collecting roller 35 of the sealing member 41 is within a range of 0.5 mm to 1.0 mm. Also, the first sealing member 45 is disposed outside by a predetermined distance W3 from an inside end of the second sealing member 46. The distance W3 is 3 mm or more, for example.

In this side sealing member 43 as well, a relationship between the position of the side sealing member 43 and the accumulation state of sheet powder or the like was obtained by the following experiment. The experimental conditions are the same as the experimental conditions shown above.

In the experimental conditions described above, a lifting height D2 (hereinafter, referred to as a height difference D2) of the extension part 41*a* of the sealing member 41 toward the collecting roller 35 by the side sealing member 43 was set to 0.0 mm, 0.25 mm, 0.5 mm and 0.75 mm and a distance W2 (hereinafter, referred to as a spacing distance W2) between the position R1 corresponding to each side edge of the maximum width-size transfer sheet passing region R and the lower sealing member 46 was varied to 0 mm, 2 mm, 3 mm and 4 mm. Then, an image of a test document with a predetermined printing rate was formed on 1,000 sheets of plain sheet (available from JKSHEET Co., Ltd.), and subsequently, the accumulation state of sheet powder or the like was determined by visually observing the collecting roller 35. As to the accumulation state of sheet powder, a case in which almost no accumulation was observed was defined as O; a case in which accumulation to an extent such that a problem occurs was observed was defined as X; and an intermediate state thereof was defined as Δ. The results of the determination are shown in Table 2.

TABLE 2

| | | a spacing distance W2 (mm) between side edge of sheet and side sealing member | | | |
|---|---|---|---|---|---|
| | | 0 | 2 | 3 | 4 |
| a height difference D2 (mm) between sealing member and lower sealing member | 0.00 | ○ | ○ | ○ | ○ |
| | 0.25 | X | ○ | ○ | ○ |
| | 0.50 | X | Δ | ○ | ○ |
| | 0.75 | X | X | X | Δ |

From Table 2 as well, it is found that the smaller the height difference D2 is and the longer the spacing distance W2 is, the less the accumulation of sheet powder occurs. From Table 2, in order to prevent the accumulation of sheet powder, in the experimental condition described above, the height difference D2 is required to be within a range of 0.00 mm to 0.50 mm and the spacing distance W2 is required to be 2 mm or more.

Incidentally, in a case where the side sealing member 43 is composed of the upper and lower sealing members 45, 46 like the embodiment, even if the height difference is shorter and the spacing distance is shorter than those in a case where the side sealing member 43 is composed of one member, good experimental results are obtained. This is because, if each extension part 41*a* of the sealing member 41 is sandwiched between the upper and lower sealing members 45, 46, the sealing member 41 is kept in a tensioned posture in the width direction in comparison with a case in which each extension part 41*a* of the sealing member 41 is lifted from the lower side. Therefore, it is considered that, even if the lifting distance (height difference) of the sealing member 41 is reduced or if the spacing distance is reduced, a suitable abutment force can be applied to the collecting roller 35 from the sealing member 41.

Incidentally, in the case where the side sealing member 43 is composed of the first and second sealing members 45, 46, since the first sealing member 45 is pressed by the collecting roller 35, the sealing member 41 may be deformed in a wavy state. Therefore, a width of the second sealing member 46 is made larger than a width of the first sealing member 45, and the sealing member 41 is lifted by the second sealing member 46 and then is pressed by the collecting roller 35. This can prevent the waving of the sealing member 41. Thus, it is preferable that the distance W3 between the inside end of the second sealing member 46 and the inside end of the first sealing member 45 be 2 mm or more.

Incidentally, the height difference and spacing distance shown above are preferred values in the experimental conditions described above, and the preferred height difference and spacing distance according to the specification of the cleaning device 10 are determined.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an image carrier having a surface on which a toner image is formed;

a rotating brush coming into contact with the surface of the image carrier and then collecting a residue adhering to the surface after transferring the toner image to a transfer sheet;

a collecting roller coming into contact with the rotating brush on a downstream side in a rotating direction of the rotating brush from a contact area between the image carrier and the rotating brush and then removing the residue collected by the rotating brush;

a cleaning blade abutting against the collecting roller on a downstream side in the rotating direction of the collecting roller from a contact area between the rotating brush and the collecting roller and then scraping the residue collected by the collecting roller;

a sealing member having an extension part extending outside from each end of the collecting roller in an axial direction, and coming into contact with the collecting roller between the contact area between the rotating brush and the collecting roller and the cleaning blade and then preventing backflow of the residue; and a side sealing member lifting the extension part toward the collecting roller on an outside at a predetermined interval from a position corresponding to each side edge of a maximum-width sheet passing region on the image carrier.

2. The image forming apparatus according to claim 1, wherein the sealing member is supported so as to come into contact with the collecting roller at a predetermined pressing force from an upstream side in the rotating direction of the collecting roller.

3. The image forming apparatus according to claim 1, wherein, in a state in which the collecting roller is not attached, the extension part is supported so as to be lifted by 0.5 mm to 1.5 mm toward the collecting roller by the side sealing member on an outside by 8 mm or more from the position corresponding to each side edge of the maximum width-size transfer sheet passing region on the image carrier.

4. The image forming apparatus according to claim 1, wherein the side sealing member has a first sealing member and a second sealing member which sandwich the sealing member between a face on a side of the collecting roller and an opposite face to the collecting roller side.

5. The image forming apparatus according to claim 4, wherein the first sealing member and the second sealing member are set in the axial direction of the collecting roller such that an inner end of the first sealing member is positioned outside from an inner end of the second sealing member.

6. The image forming apparatus according to claim 4, wherein, in the state in which the collecting roller is not attached, the extension part is supported so as to be lifted by 0.0 mm to 0.5 mm toward the collecting roller by the side sealing member on an outside by 2 mm or more from the position corresponding to each side edge of the maximum width-size transfer sheet passing region on the image carrier.

7. The image forming apparatus according to claim 1, wherein the collecting roller has a surface ten-point average roughness Rz of 2 μm or less and a maximum height Ry of 6.3 μm or less.

8. The image forming apparatus according to claim 1, wherein the collecting roller is formed by subjecting a surface of a substrate made of SUM (sulfur-composite free cutting steel) to a nickel plating processing.

9. The image forming apparatus according to claim 1, wherein a bias with a reverse polarity to a charging polarity of the toner is applied to the collecting roller.

* * * * *